United States Patent [19]

Foster et al.

[11] 3,977,919

[45] Aug. 31, 1976

[54] METHOD OF PRODUCING DOUBLY ORIENTED COBALT IRON ALLOYS

[75] Inventors: Karl Foster; Donald R. Thornburg, both of Pittsburgh, Pa.

[73] Assignee: Westinghouse Electric Corporation, Pittsburgh, Pa.

[22] Filed: Dec. 12, 1974

[21] Appl. No.: 532,284

Related U.S. Application Data

[60] Division of Ser. No. 401,766, Sept. 28, 1973, Pat. No. 3,868,278, which is a continuation of Ser. No. 228,070, Feb. 22, 1972, abandoned.

[52] U.S. Cl. ..... 148/121; 148/31.55; 148/120; 75/123 K

[51] Int. Cl.[2] ..... H01F 1/00

[58] Field of Search ..... 148/121, 120, 122, 31.55; 75/123 R, 123 K, 170

[56] References Cited

UNITED STATES PATENTS

| | | | |
|---|---|---|---|
| 2,512,358 | 6/1950 | McGeary | 148/31.55 |
| 2,717,223 | 9/1955 | Binstock et al. | 148/122 |
| 3,148,092 | 9/1964 | Shull | 148/120 |
| 3,843,424 | 10/1974 | Thornberg et al. | 148/120 |
| 3,849,212 | 11/1974 | Thornberg | 148/31.55 |
| 3,868,278 | 2/1975 | Foster et al. | 148/31.55 |
| 3,881,967 | 5/1975 | Cochardt | 148/31.55 |

*Primary Examiner*—Walter R. Satterfield
*Attorney, Agent, or Firm*—R. T. Randig

[57] ABSTRACT

An alloy and process are described for obtaining improved magnetic characteristics in iron-cobalt alloys. The iron-cobalt alloys described are characterized by a cube-on-face texture, primary recrystallized and normal grain growth microstructure. Processes are described which include both a single stage cold working and a multiple stage cold working in order to obtain the desired texture in the finished alloy.

17 Claims, 2 Drawing Figures

METHOD OF PRODUCING DOUBLY ORIENTED COBALT IRON ALLOYS

CROSS-REFERENCE TO RELATED APPLICATIONS

This application is a division of application Ser. No. 401,766, filed Sept. 28, 1973, now U.S. Pat. No. 3,868,278 which, in turn, was a continuation of application Ser. No. 228,070, filed Feb. 22, 1972, now abandoned. The present application is closely related to the following applications: Application Ser. No. 228,071, filed Feb. 22, 1972, now U.S. Pat. No. 3,843,424; Application Ser. No. 480,075, filed June 17, 1974 as a division of Application Ser. No. 228,071, now U.S. Pat. No. 3,892,604; Application Ser. No. 228,319, filed Feb. 22, 1972, now abandoned; Ser. No. 228,320, filed Feb. 22, 1972, now abandoned in favor of continuation-in-part Application Ser. No. 430,114, filed Jan. 2, 1974, now U.S. Pat. No. 3,881,967; Application Ser. No. 228,318, filed Feb. 22, 1972, now abandoned in favor of continuation-in-part Application Ser. No. 312,681, filed Dec. 11, 1972, now U.S. Pat. No. 3,849,212; and Application Ser. No. 489,324, filed July 17, 1974, a division of Ser. No. 312,681, now U.S. Pat. No. 3,892,605.

BACKGROUND OF THE INVENTION

1. Field of the Invention

The present invention relates to iron-cobalt alloys especially those iron-cobalt alloys containing between 5 and 35% cobalt and which do not undergo an order-disorder transformation phenomenon during heat treatment. The alloy is characterized by a cube-on-face texture which may be described in terms of Miller Indicies as (100) [001] and which also has a primary recrystallized microstructure and normal grain growth. The process for obtaining such cube texture involves either a single or a multiple cold working and the alloys which are produced therefrom find particular use as a magnetic core material for aircraft generators where such rotating machinery is improved by the magnetic laminations having a double orientation of the grain structure.

2. Description of the Prior Art

Great effort has been expended in recent years particularly in the aerospace industry to produce smaller and lighter weight electrical equipment. This has led to increased operating inductions in the magnetic core materials of aircraft electrical generators where, in some designs, cube or doubly oriented silicon steel has replaced nonoriented silicon steel.

Current and future advanced designs are contemplating the use of a 50% cobalt-iron alloy which is presently being marketed by the Westinghouse Electric Corporation under the trademark "HIPERCO 50". This alloy permits higher operating inductions than the 3¼% silicon iron because of its higher saturation value, namely about 24,000 gauss, as well as the low magnetocrystalline anisotropy. However, one of the main deterrents to wider use of the 50% cobalt-iron alloy is its high cost arising from the 50% cobalt content and the difficulty in cold rolling this alloy resulting from the fact that iron-cobalt alloys containing in excess of about 35% cobalt undergo, during heat treatment, a transformation phenomenon which is known as an order-disorder phenomenon. This transformation results in the production of an exceedingly brittle material which poses an extreme amount of difficulty in cold working. In order to suppress this transformation phenomenon and its resulting brittleness, elaborate steps must be taken to quench the iron-cobalt alloy, containing in excess of 35% cobalt, in ice brine before the material has a chance to transform.

Alloys in the 20 to 30% cobalt range, which have saturation values similar to the 50% cobalt-iron, can be much more readily processed. However, these alloys do not normally possess an oriented structure as commercially produced and consequently, high inductions at low field strengths have not been previously observed in these alloys because of their high positive anisotropy values.

The present invention alleviates the shortcomings of the prior art compositions and provides an alloy and a method for manufacturing the same which results in the attainment of a useful degree of cube texture or double orientation in cobalt-iron alloys having between about 5% and about 35% cobalt which alloys can be most easily cold worked. The present alloy leads to higher operating inductions than can now be obtained in the cube oriented 3¼% silicon-iron alloys or in the non-oriented alloys with similar cobalt contents.

SUMMARY OF THE INVENTION

The present invention relates to an iron-cobalt alloy which contains between about 5% and about 35% cobalt, up to 9% of at least one of the volume resistivity improving elements and the balance iron with incidental impurities. It is also preferred to maintain the manganese content at less than about 0.3% and the carbon content not in excess of 0.03%. The alloy when manufactured in accordance with one of the two preferred methods to be set forth hereinafter will exhibit at least 50% by volume of the grains having a texture in which the (100) plane is oriented within about 10° of the alloy surface and at least 50% of the oriented grains have an [001] direction aligned within 10° of the rolling direction. This is accomplished by employing either a single stage cold working process with a large cold reduction or a two stage cold reduction process with at least the final step employing a relatively large cold reduction, In addition a cube-on-edge orientation can also be developed by employing the same processes but including from 0.3% to about 1.5% chromium in the iron-cobalt alloy. The specific processes will be set forth more fully hereinafter.

DESCRIPTION OF THE PREFERRED EMBODIMENT

Figure 1:
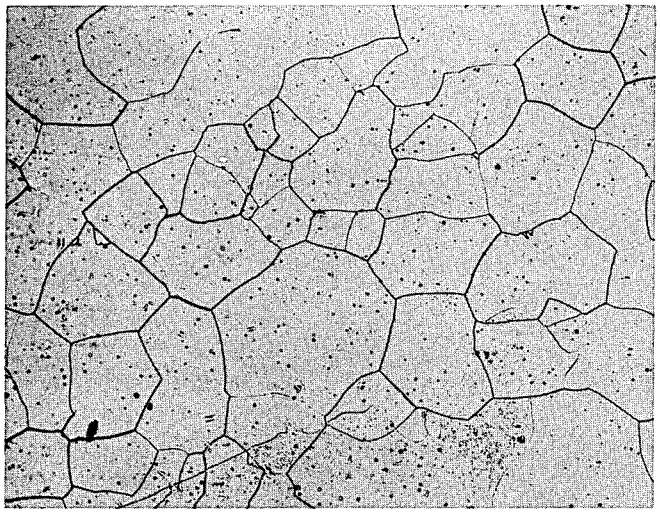
FIG. 1 is a photo micrograph taken at a magnification of 100X of the surface of an alloy of the present invention illustrating a primary recrystallized microstructure.

The alloy of the present invention may be essentially described as a binary iron-cobalt alloy in which the cobalt content is maintained with the range between about 5% and about 35%, the balance being essentially iron with incidental impurities. In this respect it should be noted that the alloy preferably contains less than about 0.3% manganese, less than about 0.03% carbon and less than about 0.01% sulphur. However, where it is desired to improve the volume resistivity of the alloy of the present invention, at least one other volume resistivity improving element may be added to the essentially binary iron-cobalt composition. Advantageously, this may include up to about 1% silicon, up to about 1% vanadium, up to about 0.5% molybdenum and not over 0.30% chromium.

While silicon, vanadium and molybdenum perform the known function of improving the volume resistivity it is highly imperative that the chromium, which also improves volume resistivity, does not exceed 0.3% by weight. It has been found that where the chromium content is in excess of about 0.3%, while improved volume resistivity is attained, the chromium is highly deleterious to the formation of the doubly oriented, or cube-on-face texture, or a (100) [001] grain orientation.

While the cobalt content may be as low as 5% in order to obtain improved saturation values it is preferred to have a minimum of at least 8% and preferbly the cobalt should be present within the range between about 18% and about 27% by weight in order to attain a saturation value which approaches that of the 50% cobalt-iron alloy. While amounts of cobalt between about 27% and 35% will produce a small increase in the saturation value the use of the higher amounts of cobalt is costly, and in the event a combination of other factors are present, this may result in the alloy exhibiting an order-disorder transformation phenomenon which can prove to be highly deleterious to high degrees of cold work which are imperative for attaining the desired cubic texture in the alloy of the present invention.

The alloy of the present invention when manufactured according to one of the processes set forth hereinafter will in its finished form exhibit at least 50% of the volume of the grains having a texture in which the (100) plane is oriented within 10° of the alloy surface and at least 50% of the oriented grains having a [001] direction aligned within 10° of the rolling direction. It has been found that as much as 70 and sometimes 80% by volume of the microstructure of the alloy will exhibit the (100) plane in the alloy surface aligned within 15° of the [001] direction.

The alloy which is maufactured in accordance with the teachings of the present invention is preferably melted employing vacuum technology for attaining the desired degree of purity which is conducive to the formation of the proper texture development. In this respect the components may be vacuum induction melted and thereafter cast into ingots which are hot rolled to a convenient intermediate gauge usually between about 0.075 and about 0.200 inch in thickness.

Following hot rolling, which is done employing conventional equipment and conventional techniques, the alloy is annealed for a time period of up to about eight hours and preferably for a time period of about 5 hours at a temperature within the range between about 850°C and the $Ac_1$ temperature of the particular alloy which has been melted and hot rolled. In no event should heat treatment take place at a temperature in excess of the $Ac_1$ temperature and while lower temperatures can be employed it will become apparent that longer time periods are required for the annealing process. Accordingly, optimum results appear to be obtained where the alloy, following hot rolling, is annealed for a time period of about five hours and at a temperature of about 900°C.

During such annealing heat treatment it is preferred to maintain a protective atmosphere around the alloy and for this reason hydrogen having a dew point of less than about −40°C is employed. Thereafter the alloy is cooled to room temperature while maintaining such protective atmosphere and the alloy is then ready for cold working in one of two preferred ways, indicated as Process A and Process B hereinafter.

Process A:

In this method of manufacturing iron-cobalt alloys for producing a cube texture as described hereinbefore, it is preferred to cold work the hot rolled material in one stage or operation without interposing any intermediate heat treatment therebetween. While one operation is desired it will be appreciated that such cold working may involve three or four steps in order to attain the required degree of cold working and such three to four steps are envisaged within the term "one cold working operation". Thus, it may be necessary to pass the alloy in a cold rolling mill between the rolls three or four times in order to attain the desired degree of reduction in the cross sectional area but the same is included within the term "one cold working operation".

In this Process A, the cold working operation must effect a reduction in the cross sectional area of at least 75% from the hot worked gauge to the finished gauge of the material. A suitable schedule within said Process A would include hot rolling the ingot to an intermediate gauge of about 0.080 inch which material is thereafter pickled, annealed for five hours at a temperature of 850°C in dry hydrogen and then cold rolled to a finished gauge in the range between 0.011 and 0.012 inch. While it will be appreciated that the final gauge material may be lighter as well as heavier than this thickness, the lighter gauges being down to ⅛th mil and the heavier gauges may be, for example, about 0.014 inch, the preferred final gauge material will have a thickness within the range between about 0.006 inch and about 0.012 inch, i.e. nominally 6 mil and 12 ml material.

Following cold working to finish gauge the alloys are once again subjected to a final heat treatment at a temperature within the range between about 850°C and the $Ac_1$ temperature of the alloy for a time period of between about 24 and about 48 hours, the alloy being subjected to a protective atmosphere of dry hydrogen or other suitable protective gas during said final heat treatment. During said final heat treatment it is also contemplated that a magnetic field having a strength of between about 5 and about 50 oersted may be employed in order to develop improved magnetic characteristics in the final alloy. However, the use of a magnetic field does not per se contribute to the cube texture development exhibited by the alloys of the present invention.

Process B:

In this method of manufacturing the iron-cobalt alloys of the present invention at least two cold working operations are envisaged. Consequently the starting material may be of a much heavier gauge from that employed in Process A. In this respect while two cold reductions are envisaged each of which effects a substantially large reduction, it is imperative that the second or last of the cold working operations in which the material is cold worked to finish gauge following an annealing after a prior cold working, must effect a reduction in the cross sectional area in excess of about 75% from the area of the previous gauge material. Thus for example, if the prior cold working produces a material having a thickness of 0.060 inch which material is thereafter annealed, a suitable final cold reduction would produce a material having a thickness of about 0.012 inch in thickness thus resulting in a final cold reduction of 80% of that from the cross-sectional area of the previous gauge material. In Process B the hot work material for example having a thickness of about 0.150 inch in thickness is annealed, for example, at 900°C for a time period of 5 hours and in an atmosphere of dry hydrogen, that is, hydrogen having a dew point of less than about −40°F. While higher temperatures as well as lower temperatures may be employed for the intermediate annealing once again the limitation is placed that the material does not become heated to a temperature in excess of the $Ac_1$ temperature in order to obtain a cube textured material characterized by a primary recrystallized microstructure which exhibits normal grain growth as opposed to some prior art materials.

The hot worked material which has been annealed is thereafter pickled and subjected to a cold working such initial cold working preferably exceeding a value of about 75% reduction in the cross sectional area. This may be done in one or more steps and it is contemplated that a hot-cold working may be employed especially where higher amounts of cobalt are employed such hot-cold working taking place at a temperature not in excess of about 300°C. Hot-cold working, as that term is used herein, contemplates a cold working at temperatures above room temperature and the recrystallization temperature of the alloy, typically at temperatues in the range between about 200°C and 300°C. The cold working which effects preferably at least a 75% reduction in the cross sectional area is followed by an annealing heat treatment once again at a temperature within the range between about 850°C and the $Ac_1$ temperature, it having been found that annealing the intermediate gauge material for about 5 hours at 900°C has given excellent results. This annealing treatment is also conducted in an atmosphere of dry hydrogen. Thereafter the material may be again cold worked to finish gauge in one or more operations.

It should be noted however that where more than one operation is performed on the material to reduce the same to finish gauge such operation must be conducted so that the final reduction of the material to finish gauge effects a reduction in the cross sectional area of at least 75%. In each of the cold working operations heretofore described in Process B it is envisaged that at the initial step in the cold working operation may take place at an elevated temperature not in excess of about 300°C. Thus it has been found that where material which is annealed for five hours at 900°C in dry hydrogen and having a hot gauge of 0.060 inch may be cold rolled at a temperature of about 260°C to a thickness of about 0.040 inch and thereafter without any intermediate heat treatment the cold working is continued to attain a desired finish gauge of about 0.012 inch in thickness. The material is then subjected to a final heat treatment at a temperature within the range between about 850°C and the $Ac_1$ temperature for obtaining the desired crystallographic orientation. As thus processed the microstructure is characterized by a primary recrystallization which exhibits normal grain growth as will appear more fully hereinafter.

Both Process A and Process B above-described may be successfully employed in producing a different type of orientation in essentially iron-cobalt alloys, which orientation has useful magnetic characteristics. Essentially, this orientation is described in terms of Miller indices as (110) [001] on cube-on-edge texture. In order to obtain the (110) [001] texture, the chemical composition of the alloy which is subjected to either Process A or Process B must be altered from that of the basic iron-cobalt alloy containing 5% to 35% cobalt. In this respect from about 0.3% to about 1.5% chromium must be added to the essentially binary iron-cobalt alloy containing from 5% to 35% cobalt. When the alloy is melted to this compositon and fabricated employing either Process A or Process B, the texture obtained is that described as (110) [001]. Ancillary thereto, the addition of 0.3% to 1.5% chromium also improves the volume resistivity.

In order to more clearly demonstrate applicants' alloy and processes for manufacture, reference may be had to Table I which illustrates the nominal compositions of a series of alloys made and tested employing the teachings of the present invention.

TABLE I

| Alloy | % Co | % Cr | % Si | % Mn | % S | % C |
|---|---|---|---|---|---|---|
| M841 | 18.0 | 2.0 | 0.5 | — | — | — |
| M844 | 18.0 | 1.0 | 1.0 | — | — | — |
| M856 | 18.0 | — | 1.0 | — | — | — |
| M859 | 18.0 | — | 1.0 | 0.05 | 0.01 | — |
| M883 | 18.0 | — | 1.0 | 0.05 | — | — |
| M887 | 10.0 | — | 2.0 | 0.05 | — | — |
| M900 | 27.4 | — | — | 0.15 | — | 0.03 |

The alloys having the composition set forth hereinbefore in Table I were processed employing three different processing schedules. Each of the alloys was induction melted in order to obtain a close control over the alloying components as well as purity of the composition. It is noted from Table I that the values set forth therein are nominal compositions and do not reflect the actual chemical compositions of the material. The following listed processes were employed in making the alloys set forth in Table I.

Process 1:

Hot roll ingot to 0.080 inch, pickle, anneal five hours at 850°C in dry hydrogen, cold roll to 0.011 – 0.012 inch.

Process 2:

Hot roll ingot to 0.080 inch, pickle, anneal five hours at 850°C in dry hydrogen, cold roll to 0.025 inch, anneal five hours at 850°C in dry hydrogen, cold roll to 0.011 – 0.012 inch.

Process 3:

Hot roll ingot to 0.150 inch, anneal five hours at 900°C in dry hydrogen, pickle, cold roll at 260°C to 0.060 inch, anneal five hours 900°C in dry hydrogen, cold roll (260°C to 0.040 inch) to 0.012 inch.

Epstein samples and one inch torque discs from the alloys so processed were annealed for 24 to 48 hours at 900° to 950°C in dry hydrogen. All samples except alloy M900 were strip annealed at 800°C prior to the final anneal. The M900 samples were put into the furnace at temperature.

Reference may be had to Table II which includes the torque and magnetic test data for the various alloys set forth in Table I and as processed by the different methods as set forth hereinbefore.

TABLE II

Properties of Oriented Co-Fe samples

| Alloy | Process | Anneal | Peak Torque (ergs/cm³) | Peak Ratio | $H_r$ (Oe) | $B_{10}$ (G) | $B_{100}$ (O) |
|---|---|---|---|---|---|---|---|
| Cubex | — | 24 hr 1200°C | 17,300 | 1.00 | 0.06 | 17,300 | 19,200 |
| Hipersil | — | 24 hr 1200°C | 167,000 | 0.34 | 0.11 | 18,300 | 19,800 |
| Hiperco 27 | — | 48 hr 900°C | * | * | 1.70 | 16,100 | 21,100 |
| M841[a] | 1 | 24 hr 900°C | 85,600 | 0.84 | 0.47 | 18,500 | 21,500 |
| M844[a] | 1 | 24 hr 900°C | 61,100 | 0.79 | 0.54 | 17,400 | 20,600 |
| M844[a] | 2 | 24 hr 900°C | 83,600 | 0.42 | 0.50 | 18,000 | 21,100 |
| M856 | 1 | 24 hr 950°C | * | * | — | — | — |
| M856 | 2 | 24 hr 950°C | 33,500 | 0.42 | — | — | — |
| M859 | 1 | 24 hr 950°C | 99,600 | 0.81 | — | — | — |
| M859 | 2 | 24 hr 900°C | 33,000 | 0.55 | — | — | — |
| M883 | 1 | 40 hr 940°C | 99,300 | 0.81 | 0:46 | 18,300 | 21,600 |
| M883 | 2 | 40 hr 940°C | 106,800 | 0.43 | 0.46 | 18,500 | 21,600 |
| M887 | 1 | 40 hr 940°C | 78,400 | 0.73 | 0.27 | 17,100 | 20,200 |
| M887 | 2 | 40 hr 940°C | 122,300 | 0.41 | 0.28 | 18,000 | 20,900 |
| M900[b] | 1 | 48 hr 900°C | 83,100 | 0.80 | 1.74 | 18,400 | 22,400 |
| M900[a,c] | 2 | 48 hr 900°C | 103,200 | 0.49 | — | — | — |
| M900 | 3 | 48 hr 900°C | 118,500 | 0.80 | 1.36 | 19,300 | 22,900 |

* No measurable torque peaks.
[a]Not annealed after hot rolling
[b]Annealed at 900°C after hot rolling, rolled at 260°C to 0.040"
[c]Hot rolled to 0.100", intermediate anneal 1 hour at 900°C, rolled at260°C to 0.040".

Data for the commercial alloys, that is the alloy manufactured and sold under the tradename CUBEX which is 3% silicon-iron having a (100) [001] grain texture, an alloy marketed under the name HIPERSIL which is a 3% silicon iron composition but having a different texture identified in terms of Miller Indicies as (110) [001] and the composition marketed under the trademark HIPERCO 27 which is an iron-cobalt alloy containing about 27% cobalt have been included in the data contained in Table II for comparison purposes. Since the silicon iron alloys are normally annealed at 1200°C to obtain secondary recrystallization and purification and while all annealing of the cobalt-iron alloys is normally done below the $\alpha \rightarrow \gamma$ transformation temperature of about 950°C, that is the $Ac_1$ temperature, no secondary recrystallization was observed in any of the cobalt-iron alloys listed in the table.

The torque curve data given for the CUBEX material are for the (100) [001] single crystal and the peak torque values are nearly the same for both the (100) [001] and the (110) [001] textures in silicon iron. The main difference in the torque curve is in the peak ratios. For the (110) [001] texture there were two large and two small peaks over 180° rotation, thus the peak ratio is the absolute value of the small peaks divided by the absolute value of the large peaks or in the case of the oriented (110) [001] composition the peak ratio for perfect orientation is about 0.34. On the other hand the (100) [001] torque curve has four equal peaks thereby resulting in a peak ratio of 1.0 for a perfect orientation of the CUBEX brand material. The commercial HIPERCO 27 brand alloy had no measurable torque peaks and a low $B_{10}$ value thereby indicating no appreciable degree of grain orientation or texture exhibited thereby.

An examination of the data contained in Table II indicates that the alloys which were made and tested employing Process 1 generally show a relatively high peak ratio of about 0.8 and where high torque values are obtained, indicate a tendency toward (100) [001] texture. Process 2, on the other hand, generally resulted in lower torque ratios of between about 0.4 and 0.5, indicating a high degree of (110) [001] texture for high peak torque values. The tendency toward cube texture formation with a large cold reduction has been further borne out with domain pattern observations in addition to the foregoing magnetic data. Alloy M856 which had neither manganese nor chromium additions had no measurable torque peaks for Process 1 and low peaks for Process 2 indicating that without the presence of at least one of these elements good cube texture development is not obtained. On the other hand where the chromium exceeds about 0.3% as will be shown more clearly hereinafter rather than forming good cube texture the alloy has a tendency to be formed with the cube-on-edge orientation. Alloy M859 which had an addition of sulfur demonstrated a high peak torque value and a high peak ratio for Process 1 but a low peak torque value for Process 2 indicating that the double orientation process is not as critical with regard to the sulphur content as in the (110) [001] texture formation.

Alloy M883 is of particular interest because Processes 1 and 2 result in very similar peak torque values and almost identical magnetic properties in the rolling direction with quite different torque ratios. Alloy M900 was the only alloy treated by Process 3 which resulted in the same peak ratio as Process 1 together with a higher peak torque value indicating a high degree of double or cube-on-face orientation. Since the $B_{10}$ value for alloy M900 employing Process 3 measured in the rolling direction is higher than that of commercial cube-on-edge silicon-iron and much higher than the 27% cobalt alloy, the degree of final cold reduction appears to play a major role in determining whether doubly oriented, that is cube-on-face orientation, or the singly oriented cube-on-edge texture is formed. Consequently two or more large cold reductions result in an optimum process for the formation of double orientation in cobalt-iron alloys.

Further examination of the tests results set forth for the alloys hereinbefore indicate that a fairly high degree of double orientation has been obtained by primary recrystallization and normal grain growth. Since this is obtained in cobalt-iron alloys which can be readily cold worked, this results in improved induction values over commercially available HIPERCO 27 brand alloys or 3% silicon-iron alloys. Moreover, when it is considered that the useful textures have been obtained over a wide range of alloy compositions advantage can be attained in utilizing the lower amounts of cobalt in order to obtain values for the saturation induction approachng those of the much higher alloy 50% cobalt-iron composition.

To substantiate the aspect of the texture development samples of alloy identified as M900 and which were processed to finish gauge employing Processes 1 and 3 where analyzed for their texture by domain measurement. The following results were obtained.

TABLE III

| Sample | % (100) | % (110) | % 10° — [100] | % 15° — [100] |
|---|---|---|---|---|
| M 900-1 | 51 | 11 | 63 | 72 |
| M 900-3 | 62 | 11 | 72 | 82 |

These results are consistent with the torque values.

From the test results set forth in Table III it is seen that in excess of 50% of the grains by volume had the (100) plane oriented within 10° of the surface of the alloy and 63% of the oriented grains were within 10° of the [001] or rolling direction. The actual values for the same characteristics employing Process 3 confirm the operability of Process 3. These results are consistent with the torque values set forth in Table II hereinbefore.

Alloy M901 was melted with the same nominal composition namely about 27.4% cobalt, about 0.15% manganese, about 0.03% carbon and the balance iron. This alloy was hot rolled to 0.180 inch in thickness and annealed five hours at 900°C in dry hydrogen, cold rolled, the first step occurring at a temperature of 300°C to 0.080 inches, annealed for a time period of 7 hours at 900°C and again cold rolled, the initial step being to a thickness of 0.040 inches and at a temperature of 300°C and thereafter at room temperature to a final gauge of 0.012 inches. Torque discs, Epstein samples and punched rings the latter having a three-inch outside diameter by 2¼ inch inside diameter were annealed for 48 hours at 900°C. The material demonstrated a peak torque value of 130,700 ergs/cm$^3$ and a peak ratio of 0.89 indicating a high degree of doubly oriented or cube-on-face texture. Domain analysis indicated 79% by volume of the grains were within 12° of the (100) and 11% by volume of the grains were within 12° of the (110); 78% of the grains had a [100] direction within 10° of the rolling direction and 88% within 15°.

Reference is now directed to Table IV and the magnetic properties which were measured on Epstein and ring samples annealed 48 hours at 900°C and ring samples which were reannealed for 2 hours at 850°C in a 10 oersted field and thereafter furnace cooled:

TABLE IV

| Sample | $H_c$ (Oe) | $B_r$ (G) | $B_{10}$ (G) |
|---|---|---|---|
| Epstein (48 hrs 900°C) | 0.46 | 5,900 | 20,500 |
| Ring (48 hrs 900°C) | 0.58 | 3,500 | 16,400 |
| Ring-Field Annealed | 0.22 | 14,800 | 18,200 |

From the foregoing test results it is seen that the Epstein sample had very high $B_{10}$ value in the rolling direction as expected from the high degree of texture. The as-annealed ring sample had a much lower $B_{10}$ value than expected for the cube texture and both had low remanent values. Field annealing the ring sample resulted in a large decrease in the coercive force and an increase in the remanence value while the $B_{10}$ value increased to a level consistent with the degree of orientation. These results indicate the large beneficial effect of field annealing cobalt-iron alloys in general and cube textured material in particular.

Another series of alloys were melted to study the effect of the cobalt and chromium contents on the cube texture formation. Table V contains the nominal chemical composition of the alloys so made and tested together with the volume resistivity as exhibited by each of the alloys.

TABLE V

| No. | % Co | % Cr | % Mn | % C | $\rho$ ($\mu\Omega$-cm) |
|---|---|---|---|---|---|
| M 905 | 18.0 | — | 0.15 | 0.03 | 20.0 |
| M 907 | 19.5 | — | 0.15 | 0.03 | 19.3 |
| M 909 | 21.0 | — | 0.15 | 0.03 | 18.6 |
| M 911 | 22.5 | — | 0.15 | 0.03 | 17.6 |
| M 913 | 24.0 | — | 0.15 | 0.03 | 16.3 |
| M 915 | 25.5 | — | 0.15 | 0.03 | 14.9 |
| M 917 | 27.0 | — | 0.15 | 0.03 | 13.8 |
| M 906 | 18.0 | 0.6 | 0.15 | 0.03 | 24.6 |
| M 908 | 19.5 | 0.6 | 0.15 | 0.03 | 24.4 |
| M 910 | 21.0 | 0.6 | 0.15 | 0.03 | 24.1 |
| M 912 | 22.5 | 0.6 | 0.15 | 0.03 | 23.6 |
| M 914 | 24.0 | 0.6 | 0.15 | 0.03 | 22.9 |
| M 916 | 25.5 | 0.6 | 0.15 | 0.03 | 22.6 |
| M 918 | 27.0 | 0.6 | 0.15 | 0.03 | 22.2 |

The resistivity data set forth in Table V shows a fairly sharp decrease in resistivity with increasing cobalt content in this range for essentially binary alloys. The 0.6% chromium addition increased the resistivity and tended to make it more constant with increasing cobalt content. It is for this reason that chromium is added to commercial HIPERCO 27 brand alloy to reduce high frequency losses. The alloys set forth in Table V were hot rolled to 0.180 inch in thickness, annealed five hours at 900°C in dry hydrogen cold rolled to 0.080 inches in thickness, annealed 5 hours at 900°C in dry hydrogen and cold rolled to a finish gauge of 0.012 inches in thickness. Torque and Epstein samples in the rolling direction were strip annealed for about 5 minutes at 850°C and then reannealed for 48 hours at 900°C in dry hydrogen. Reference is directed to Table VI which sets forth the test results as measured on each of the alloys:

TABLE VI

| No. | Peak Torque (ergs/cm$^3$) | Torque Ratio | $H_c$ (Oe) | $B_{10}$ (G) |
|---|---|---|---|---|
| M 905 | 129,200 | .75 | .53 | 19,100 |
| M 907 | 126,800 | .70 | .50 | 18,900 |
| M 909 | 130,800 | .71 | .46 | 18,800 |
| M 911 | 122,800 | .72 | .55 | 18,900 |
| M 913 | 124,500 | .57 | .61 | 18,700 |
| M 915 | 107,700 | .71 | .62 | 18,200 |
| M 917 | 102,200 | .72 | .62 | 18,500 |
| M 906 | 193,200 | .40 | .58 | 20,800 |
| M 908 | 194,000 | .37 | .46 | 20,700 |
| M 910 | 193,800 | .35 | .54 | 20,200 |
| M 912 | 162,300 | .43 | .54 | 19,600 |
| M 914 | 164,400 | .37 | .61 | 19,500 |
| M 916 | 145,700 | .39 | .64 | 19,300 |
| M 918 | 139,000 | .35 | .69 | 19,800 |

From the test results set forth in Table VI it is seen that the samples with no chromium addition had torque curves indicating a fairly high degree of cube texture as expected. The alloys containing chromium however, had torque curves indicating a high degree of cube-on-edge or (110) [001] orientation. The $B_{10}$ values exhibited by the alloys correlated well with the torque data. These data show unequivocally that the chromium addition tends to promote the (110) [001] texture in cobalt-iron alloys and as a result thereof must be limited to a maximum of not in excess of 0.3% by weight and preferably less than about 0.15% were cube-on-face orientation is desired in the end product. Where, however, cube-on-edge orientation is desired, chromium must be added in the range between 0.3% and 1.5% by weight.

In order to verify the test results set forth hereinbefore, alloy M 904 with a nominal composition of 25.4% cobalt, 0.6% chromium, 0.15% manganese, 0.03% carbon and the balance essentially iron was melted and tested. This alloy was hot rolled to 0.180 inch in thickness, annealed 5 hours at 900°C in dry hydrogen, cold rolled with the initial step being at a temperature of 300°C to 0.040 inch in thickness, annealed 1 hour at 900°C in dry hydrogen, and cold rolled to 0.004 inch in thickness final gauge. The finished material was annealed for 48 hours at 900°C and exhibited a maximum torque value of 128,000 ergs/cm³ and a peak ratio of 0.48, indicating a high degree of (110) [001] texture. A tape of this material was strip annealed for about 5 minutes at 815°C, coated with alumina, wound into a core and annealed 24 hours at 900°C with the following properties.

TABLE VII

| Anneal | $H_c$ (Oe) | $B_r$ (G) | $B_{10}$ (G) | $B_{100}$ (B) | $P_c$ 17/400 (W/lb) | $P_c$ 20/400 (W/lb) |
|---|---|---|---|---|---|---|
| no field | 0.83 | 9,500 | 19,600 | 23,500 | 15.34 | 20.52 |
| with field | 0.36 | 17,000 | 19,800 | 23,500 | 11.78 | 17.13 |

From the data set forth in Table VII it is seen that the field anneal resulted in a large decrease in the coercive force and an increase in the remanence. In addition, the high frequency watt losses measured at 400 Hz shows a substantial decrease with field annealing while there has been almost no charge exhibited in the $B_{10}$ or $B_{100}$ values.

In an attempt to raise the volume resistivity exhibited by the alloy of the present invention the following listed alloys were melted with the additions there indicated and processed in order to attain the desired double orientation or cube texture.

TABLE VIII

| No. | % Oo | % Cr | % Si | % V | % Mn | $\rho$ ($\mu\Omega$-cm) |
|---|---|---|---|---|---|---|
| M 961 | 25.0 | — | 0.5 | 0.5 | 0.05 | 22.7 |
| M 963 | 25.0 | 0.25 | 0.5 | 0.25 | 0.05 | 24.4 |

TABLE VIII-continued

| No. | % Oo | % Cr | % Si | % V | % Mn | $\rho$ ($\mu\Omega$-cm) |
|---|---|---|---|---|---|---|
| M 964 | 25.0 | 0.25 | 0.5 | 0.25 | 0.15 | 25.0 |
| M 965 | 25.0 | 0.25 | 0.5 | — | 0.05 | 22.6 |

It is noted from the data contained in Table VIII that all alloys exhibit considerably higher resistivities than the binary 25% cobalt-iron alloy. The alloys having the composition set forth in Table VIII were hot rolled to 0.180 inches, annealed 5 hours at 900°C, hot cold rolled at 300°C to 0.080 inch, annealed 5 hours at 900°C and cold rolled at 300°C to 0.040 inch and thereafter without any intermediate or additional annealing, cold rolled to both 6 and 12 mils final thicknesses. Torque samples and Epstein samples in the rolling direction were strip annealed for 5 minutes at 850°C in dry hydrogen and then annealed 24 hours at 900°C in dry hydrogen with the following listed results:

TABLE IX

| Alloy | Thickness (mils) | Peak Torque (ergs/cm³) | Torque Ratio | $H_c$ (Oe) | $B_{10}$ (G) | $P_c$ 20/400 (W/lb) |
|---|---|---|---|---|---|---|
| M 961 | 12 | 112,600 | .80 | .57 | 19,500 | 41.31 |
| M 963 | 12 | 120,100 | .84 | .54 | 19,400 | 43.45 |
| M 964 | 12 | 115,800 | .78 | .59 | 18,800 | 44.18 |
| M 965 | 12 | 123,700 | .88 | .52 | 19,700 | 39.89 |
| M 961 | 6 | 74,800 | .77 | .48 | 18.300 | 29.17 |
| M 963 | 6 | 77,000 | .74 | .41 | 19,000 | 29.13 |
| M 964 | 6 | 80,300 | .75 | .46 | 19,100 | 26.21 |
| M 965 | 6 | 112,300 | .84 | .43 | 19,400 | 28.01 |

From the test results set forth in Table IX it is noted that the torque values indicate a high degree of cube texture in all 12 mil samples, and a somewhat lower degree of texture in the thinner samples. X-ray pole figure analyses of the material having a thickness of 12 mils namely M 961 and M 965 indicated that 65% and 79% of the grains were within 15° of (100), respectively. The pole figure also indicated very good directional texture.

Figure 2:
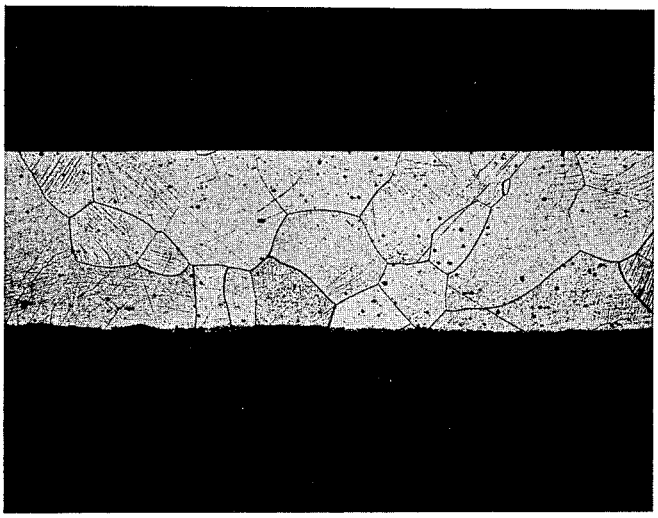
FIG. 2 is a photo micrograph taken at a magnification of 100X of a cross-section of the same alloy further illustrating the microstructure similar to FIG. 1.

Referring now to the photo micrographs of FIGS. 1 and 2, it is observed that the structure so produced by the process of the present invention exhibits equiaxed grains and of normal grain growth. In contrast to secondarily recrystallized microstructures, in which one or more substantially preferably oriented grains grow at the expense of the other grains thereby resulting in a duplex grain structure, FIG. 1 closely illustrates a primary recrystallized mocrostructure. Examination of FIG. 2 which is a cross-section of the alloy of FIG. 1 reveals that normal grain growth has occurred. This results from the fact that the grains do not extend completely through the thickness of the alloy as is the observation in secondarily recrystallised microstructures.

The data set forth hereinbefore clearly demonstrates the production of an iron cobalt alloy having a high degree of cube-on-face orientation in the microstructure. This orientation is achieved by employing a process of primary recrystallization and normal grain growth. By critically controlling the method of processing the alloys as well as by controlling the chemical composition especially the chromium content, outstanding results are obtained enabling the use of these materials in such applications as aircraft generators where high saturation values are needed in the alloys forming the magnetic core thereof.

We claim as our invention:

1. In the process of producing improved magnetic characteristics in iron cobalt alloys, the steps comprising making an alloy consisting essentially of between about 5% and about 35% cobalt, up to about 2% silicon, less than about 0.3% chromium, less than about 0.03% carbon and the balance essentially iron with incidental impurities, hot working the alloy at a temperature within the range between about 1000°C and 1100°C to an intermediate gauge, subjecting the intermediate gauge alloy to an annealing treatment at a temperature within the range between about 800°C and 950°C, cold working the intermediate gauge alloy in one or more steps to the desired finish gauge, at least the last of said cold working steps effecting a reduction in the cross sectional area of the alloy in excess of about 75% and thereafter annealing at a temperature within the range between about 850°C and the $Ac_1$ temperature, said process being effective for producing a high grain volume of (100) [001] texture by primary recrystallization and normal grain growth.

2. The process of claim 1 in which the alloy is cold reduced at least 75% in cross sectonal area in each step.

3. The process of claim 1 in which all anneals take place in hydrogen having a dew point of less than about −40°C.

4. The process of claim 2 in which an anneal at a temperature within the range between about 800°C and 950°C is interposed between each cold working step.

5. The process of claim 2 in which the alloy is hot-cold worked at a temperature of up to 300°C.

6. The process of claim 1 in which the finish gauge annealed alloy is reannealed at a temperature within the range between about 800°C and 900°C while subjected to a magnetic field having a strength of between about 5 and about 50 oersteds.

7. In the method of producing improved magnetic characteristics in iron cobalt alloys the steps comprising making an alloy consisting essentially of between about 10% and about 30% by weight of cobalt, less than 0.25% chromium, up to 3% silicon, less than 0.15% manganese, less than 0.03% carbon and the balance iron with incidential impurities, hot working the alloy to a desired intermediate gauge, annealing the intermediate gauge material, cold working the intermediate gauge material in more than one cold working operation to finish gauge with an anneal interposed between each cold working operation, said last cold working to finish gauge effecting at least a 75% reduction in the cross sectional area from the preceding gauge and thereafter heat treating the finish gauge material at a temperature between about 800°C and the $Ac_1$ temperature of the alloy, said iron-cobalt alloy exhibiting more than 50 volume percent of the grains have a texture in which the (100) plane is oriented within 10° of the surface of the alloy and at leasat 50% of the oriented grains have an [001] direction aligned within 10° of the rolling direction.

8. The method of claim 7 in which the finish gauge thickness is within the range between about 11 mil and 14 mil.

9. The method of claim 7 in which the last cold working to finish gauge effects a reduction in cross sectional area of between about 80% and 95%.

10. The method of claim 7 in which the anneal which is interposed between cold working operations takes place at a temperature within the range between about 700°C and about 900°C.

11. In the method of producing iron-cobalt alloys having improved magnetic characteristics, the steps comprising making an alloy consisting essentially of between about 5% and about 35% cobalt, up to about 2% silicon, less than 0.2% chromium, up to about 0.2% manganese, less than about 0.03% carbon and the balance iron with incidental impurities, hot working the alloy at a temperature within the range between about 1000°C and 1100°C to an intermediate gauge, annealing the intermediate gauge alloy at a temperature within the range between about 800°C and 900°C, cold working the intermediate gauge alloy to finish gauge in one operation and thereafter annealing the finish gauge alloy at a temperature within the range between 850°C and the $Ac_1$ temperature of the alloy, said alloy having a high grain volume of (100) [001] texture obtained by primary recrystallization and normal grain growth.

12. The method of claim 11 in which the cold working effects a reduction in cross sectional area of more than 75%.

13. The method of claim 11 in which the cold working takes place at a temperature of up to 300°C.

14. The process of claim 1 in which all cold working takes place in one operation and said cold working is effective for reducing the cross-sectional area at least 75% to finish gauge.

15. The process of claim 1 in which the cold working takes place in two operations with an intermediate anneal interposed therebetween, each of said cold working operations effecting a reduction in cross sectional area of at least 75%.

16. The process of claim 14 in which a portion of the cold working operation is a hot-cold working at a temperature within the range between 200°C and 300°C.

17. The process of claim 1 in which the cobalt content of the alloy is between about 18% and about 27%.

* * * * *